US006919110B2

(12) United States Patent
Oketani et al.

(10) Patent No.: US 6,919,110 B2
(45) Date of Patent: Jul. 19, 2005

(54) PACKAGED PRODUCT FOR INK-JET RECORDING MATERIAL, AND RECORDING METHOD AND RECORDED MATERIAL USING INK-JET RECORDING MATERIAL

(75) Inventors: Masao Oketani, Tokyo (JP); Yukio Tokunaga, Tokyo (JP); Kazuhito Hori, Nagano (JP)

(73) Assignees: Mitsubishi Paper Mills Limited, Tokyo (JP); Seiko Epson Corporation, Tokyo (JP)

( * ) Notice: Subject to any disclaimer, the term of this patent is extended or adjusted under 35 U.S.C. 154(b) by 20 days.

(21) Appl. No.: 10/084,888

(22) Filed: Mar. 1, 2002

(65) Prior Publication Data

US 2002/0164463 A1 Nov. 7, 2002

(30) Foreign Application Priority Data

Mar. 5, 2001 (JP) ..... 2001-060657

(51) Int. Cl.[7] ..... B41M 5/40

(52) U.S. Cl. ..... 428/32.34; 347/105

(58) Field of Search ..... 428/32.34; 347/105

(56) References Cited

U.S. PATENT DOCUMENTS

| | | | | | |
|---|---|---|---|---|---|
| 5,591,294 | A | * | 1/1997 | Sakaki et al. | 156/250 |
| 6,153,288 | A | * | 11/2000 | Shih et al. | 428/195 |
| 6,165,606 | A | * | 12/2000 | Kasahara et al. | 428/323 |
| 2003/0063173 | A1 | * | 4/2003 | Gonzalez | 347/104 |

* cited by examiner

*Primary Examiner*—B. Shewareged
(74) *Attorney, Agent, or Firm*—Paul E. White, Jr.; Manelli Denison & Selter PLLC

(57) ABSTRACT

There are disclosed a packaged product for an ink-jet recording material which has a protective sheet for protecting the surface of the outermost ink-receptive layer of the ink-jet recording material, wherein a protective paper sheet is used as the protective sheet in which a difference between the pH of its surface which makes contact with the surface of the outermost ink-receptive layer and the pH of the surface of the ink-receptive layer is 1.5 or smaller, and a recording method and a recorded material using the ink-jet recording material.

23 Claims, No Drawings

PACKAGED PRODUCT FOR INK-JET RECORDING MATERIAL, AND RECORDING METHOD AND RECORDED MATERIAL USING INK-JET RECORDING MATERIAL

BACKGROUND OF THE INVENTION

1. Field of the Invention

The present invention relates to a packaged product for an ink-jet recording material, a recording method using the same, and a recorded material prepared by the recording method. Particularly, it relates to a packaged product for an ink-jet recording material which is free from change in hue after printing between the surface of the outermost ink-receptive layer and the surface(s) of other (inner) ink-receptive layer(s).

2. Prior Art

As a recording material to be used for an ink-jet recording system, it has been known a recording material in which a porous ink-absorption layer comprising a pigment such as amorphous silica, and a water-soluble binder such as polyvinyl alcohol, is provided on a support such as usual paper or so-called ink-jet recording paper.

There have been proposed recording materials obtained by coating a silicon-containing pigment such as silica, with an aqueous binder onto a paper support as disclosed in, for example, Japanese Provisional Patent Publications No. 51583/1980, No. 157/1981, No. 107879/1982, No. 107880/1982, No. 230787/1984, No. 160277/1987, No. 184879/1987, No. 183382/1987, No. 11877/1989, No. 21508/1991, No. 67986/1992 and the like.

Also, in Japanese Patent Publication No. 56552/1991, Japanese Provisional Patent Publications No. 188287/1990, No. 132728/1996, No. 81064/1998, No. 119423/1998, No. 175365/1998, No. 193776/1998, No. 203006/1998, No. 217601/1998, No. 20300/1999, No. 20306/1999 and No. 34481/1999, and the like, there have been described to use synthetic silica fine particles prepared by a gas phase process (hereinafter referred to as "fumed silica"). This fumed silica is ultrafine particles having an average primary particle diameter of several nm to several tens nm, and has a characteristic feature that high glossiness can be obtained. In recent years, a photo-like recording sheet is earnestly desired and glossiness becomes more important. It has been proposed a recording material in which an ink-receptive layer mainly comprising the fumed silica on a water resistant support such as a polyolefin resin coated paper (a material in which a polyolefin resin such as polyethylene or the like is laminated on the both surfaces of paper) or a polyester film.

A product form of the above ink-jet recording material is generally a roll having a length of several meters to several tens of meters or a sheet-accumulated stack of several tens to several hundreds of sheets. In a general method for packaging the ink-jet recording material in a rolled form, the ink-jet recording material is rolled up with the ink-receptive layer exposed to outside in consideration of curl, a protective sheet is wound around the outermost surface of the roll at least once, and the resulting roll is put in a plastic bag and then put in a box. Meanwhile, in a general method for packaging the ink-jet recording material in a sheet-accumulated stack form, the ink-jet recording material is stacked with a protective sheet (also referred to as pad paper) for protecting the surface of the outermost (uppermost or lowermost) ink-receptive layer placed on the outermost surface, the resulting stack of sheets is put in a plastic bag and then put in a box. As the above protective sheet placed on the outermost surface, paper has heretofore been generally used.

It has been found that when printing is conducted on the ink-jet recording material packaged in the above product forms by a printer or the like, change in hue occurs between the surface of the ink-receptive layer and the surface(s) of inner ink-receptive layer(s) after printing.

SUMMARY OF THE INVENTION

Therefore, an object of the present invention is to provide a packaged product for an ink-jet recording material which prevents from causing change in hue after printing between the surface of the outermost ink-receptive layer and the surface(s) of inner ink-receptive layer(s) when printing is conducted on the ink-jet recording material by a printer. Another object of the present invention is to provide a recording method using an ink-jet recording material packaged in the above packaged product and a material recorded by the recording method.

The above objects of the present invention can be basically achieved by the following packaged products and others.

(1) A packaged product for an ink-jet recording material which has a protective sheet for protecting the surface of the outermost ink-receptive layer of the ink-jet recording material, wherein a protective paper sheet in which a difference between the pH of its surface which makes contact with the surface of the outermost ink-receptive layer and the pH of the surface of the ink-receptive layer is 1.5 or smaller is used as the protective sheet.

(2) A packaged product for an ink-jet recording material which has a protective sheet for protecting the surface of the outermost ink-receptive layer of the ink-jet recording material, wherein a protective paper sheet whose surface which makes contact with the surface of the outermost ink-receptive layer has been made water-resistant or a protective plastic sheet is used as the protective sheet.

(3) A recording method which causes an ink composition to adhere to a recording medium so as to conduct printing on the recording medium, wherein the ink-jet recording material as mentioned above is used as the recording medium.

(4) An ink-jet recording method which sprays droplets of an ink composition and causes the droplets to adhere to a recording medium so as to conduct printing on the recording medium, wherein the ink-jet recording material as mentioned above is used as the recording medium.

(5) A recorded material on which printing has been conducted by the recording methods as mentioned above.

DESCRIPTION OF THE PREFERRED EMBODIMENTS

In the following, the present invention will be described in detail. In general, packaged products for an ink-jet recording material to which the present invention is applied are broadly divided into two types. One type has a roll form in which a long sheet of an ink-jet recording material of several meters to several tens of meters is rolled up, and the other type has a sheet-accumulated stack form in which several tens to several hundreds of sheets cut into an end use size are stacked.

In the case of the roll form, an ink-jet recording material is often rolled up such that the surface of its ink-receptive layer becomes an external surface to prevent from causing curl. A protective sheet is generally wound around the outermost surface at least once for protecting the outermost surface. The resulting roll is put in a bag made of a plastic such as a polyolefin resin and then put in a box to form into a final packaged product.

Meanwhile, in the case of the sheet stack form, on the surface of the outermost (uppermost or lowermost) ink-receptive layer, a protective paper sheet (also referred to as pad paper) of the same size as that of the outermost ink-receptive layer is placed for the purpose of protecting the outermost ink-receptive layer. The resulting sheet stack is put in a bag made of a plastic such as a polyolefin resin and then put in a box to form into a final packaged product.

An embodiment of a protective sheet used in the present invention is a protective paper sheet. The protective paper sheet is advantageous from the viewpoints of shock absorbability, packageability, suitability for automatic packaging and costs. Although there are a variety of paper, the present inventors have paid attention to the pH of the surface of paper and have found that use of paper whose surface has a pH close to that of the surface of the ink-receptive layer can prevent a change in hue between the surface of the outermost ink-receptive layer and the surfaces of inner ink-receptive layers after printing from occurring. To be more specific, in the above packaged products, while the surfaces of inner ink-receptive layers make contact with the underside of an ink-jet recording material, only the surface of the outermost ink-receptive layer makes contact with a protective sheet. It has been found that when the ink-jet recording material is stored in the above condition after packaged to be a product, the pH of the surface of the ink-receptive layer which is in contact with the protective sheet is affected by the pH of the surface of the protective sheet, thereby causing the phenomenon that the pH of the surface of the outermost ink-receptive layer becomes different from the pH of the surfaces of the inner ink-receptive layers, with the result that a difference in the pHs of the surfaces of the ink-receptive layers causes a change in hue.

Therefore, the present invention is characterized in that a difference between the pH of the surface of a protective paper sheet which makes contact with the surface of the outermost ink-receptive layer and the pH of the surface of the ink-receptive layer is 1.5 or smaller. It is preferred to use a protective paper sheet having a difference in the pHs of the surfaces of 1.0 or smaller. The pH of the surface of paper can be adjusted to any given pH value at the time of producing a pulp or forming the pulp into paper. Therefore, paper having a desired pH can be obtained. In addition, paper having a variety of pHs is commercially available and can be selected as appropriate.

Further, a variety of coated paper can also be used as the above protective paper sheet. When the coated surface of coated paper makes contact with the surface of the outermost ink-receptive layer, the pH of the coated surface is a subject of interest. A variety of chemicals known as coatings can be contained in the coating layer of the above-mentioned coated paper. Illustrative examples of such chemicals include various pigments such as kaolin, clay, satin white, titanium oxide, aluminum hydroxide, zinc oxide, barium sulfate, silica, activated clay, lake and plastic pigment; various polymer latexes such as styrene-butadiene latex, vinyl acetate-acrylate latex, ethylene-vinyl acetate latex, butadiene-methyl methacrylate latex or vinyl acetate-butyl acrylate latex; and various binders such as a polyvinyl alcohol, a copolymer of maleic anhydride and other vinyl monomer, an acrylic acid-methacrylate copolymer, oxidized starch, etherified starch, esterified starch, enzyme-modified starch, casein and soybean protein.

The thickness of paper to be used as the protective sheet in the present invention varies depending on package forms. In the case of the roll form, relatively thin paper is suitable in view of the need for being wound around, and its thickness is suitably about 30 to 200 $\mu$m. In the case of the sheet-accumulated stack form, since relatively high rigidity is required, the thickness of paper is suitably about 150 to 1,000 $\mu$m.

Another embodiment of the present invention is to use a protective paper sheet whose surface which makes contact with the surface of the outermost ink-receptive layer has been made water-resistant. By using paper as a substrate, advantages such as shock absorbability and packageability (moderate rigidity is effective for packaging) which are properties inherent in paper can be enjoyed as described above. In the above embodiment, both surfaces of the protective paper sheet may be subjected to water-resistant treatment. The water-resistant treatment as used herein means lamination of a hydrophobic plastic resin film on the surface of paper or application of a plastic resin layer to the surface of paper. Illustrative examples of such a plastic include a homopolymer of an olefin such as a polyethylene, polypropylene, polybutene or polypentene, a copolymer of two or more olefins such as an ethylene-propylene copolymer, mixtures thereof, a polyester resin such as a polyethylene terephthalate, a diacetate resin, a triacetate resin, an acrylic resin, a polycarbonate resin, polyvinyl chloride, a polyimide resin, cellophane and celluloid.

Another water-resistant treatment is a method in which an electron beam curing resin layer or an ultraviolet ray curing resin layer is applied to the surface of paper and irradiated with an electron beam or ultraviolet ray to cure the layer.

Moreover, another water-resistant treatment is water repellency treatment. Illustrative examples of usable water-repellent agents include (1) a silicone-based water-repellent agent such as a silicone oil, a silicone oil emulsion and sodium methylsiliconate as exemplified by methyl hydrogen polysiloxane, hydroxyl group-terminated dimethyl polysiloxane and dimethyl polysiloxane or a silicone-based water-repellent agent mixed with, as an aid, an organic acid salt such as butyl titanate or an organic acid salt of aluminum, tin, lead, zinc or the like, (2) a paraffin wax, a wax emulsion, or a combination of these waxes with metal salts such as an aluminum salt or zirconium salt, (3) a zirconium-containing organic compound such as zirconium oxychloride, zirconium acetate, zirconium carbonate or antimony zirconium carbonate, (4) a quaternary ammonium salt such as stearoyl methylamide or methylene pyridinium salt, (5) N-methylol fatty acid amide such as N-methylol stearic acid amide, and (6) a fluorocarbon such as perfluoromonocarboxylic acid chloro complex salt or a fluorinated-alkyl acrylate. These water-repellent agents can be dissolved in water or an organic solvent and the resulting mixture can be applied to or impregnated into paper substrate.

A thickness of the resin layer for the above-mentioned water-resistant treatment is suitably about 5 to 50 $\mu$m. A thickness of paper which is employed as a base material for a protective sheet is the same or slightly thinner than in the above-mentioned protective paper sheet. By subjecting a surface which is made contact with the ink-receptive layer of the protective sheet to water-resistant treatment, an effect of a pH of a paper base material of the protective paper sheet can be minimized as small as possible.

A still another embodiment of the present invention is to use a protective sheet comprising a plastic resin. As the plastic resin to be used in the present invention, the plastic resin as mentioned above may be mentioned. A thickness of the protective sheet made of the plastic resin is also the same as that of the protective paper sheet as mentioned above.

The ink-jet recording material to be applied to the packaged product of the present invention is not particularly limited, and preferred is an ink-jet recording material comprising a support and at least one ink-receptive layer mainly containing inorganic fine particles. As the inorganic fine particles, there may be mentioned, for example, silica, calcium carbonate, alumina or alumina hydrate, or magnesium silicate, preferably silica fine particles, alumina or alumina hydrate. Particularly preferred is silica and fumed silica is more preferred.

The ink-receptive layer mainly containing fumed silica preferably has a layer surface pH (surface pH) of about 3 to about 6, more preferably about 3 to about 5 in view of water resistance, light resistance, glossiness and coloring property after printing, dispersing stability of the fumed silica and stability of a liquid property such as a viscosity of a coating solution in total. On the other hand, however, in this pH region, pH dependency of a cyan ink coloring property is particularly large, so that a problem arises that coloring property of cyan ink changes due to the fact that a surface pH of an outermost ink-receptive layer and that of an inner ink-receptive layer become different from each other during the storage as mentioned above.

In the present invention, the phrase that the ink-receptive layer mainly contains inorganic fine particles means that the inorganic fine particles are contained in the total solid content of the ink-receptive layer of 50% by weight or more, preferably 60% by weight or more, further preferably 65% by weight or more. By mainly containing the inorganic fine particles therein, the ink-receptive layer becomes a porous void layer whereby ink absorption property is improved. In particular, fumed silica is used, it has an average primary particle size of several nm to several tens nm, which means that it is ultrafine particles, so that high glossiness can be obtained. On the other hand, as compared with the case where other inorganic fine particles are used, the resulting ink-receptive layer containing fumed silica has high surface smoothness, high adhesiveness with the above-mentioned protective sheet and it likely accepts an effect of the protective sheet.

Thus, the packaged product of the present invention is particularly useful when the fumed silica is used at the ink-receptive layer. In synthesized silica, there are two types of materials, one of which is prepared by the wet process (precipitated silica) and the other is prepared by the gas phase process (fumed silica). As the silica prepared by the wet process, there are (1) a silica sol obtained by metathesis of sodium silicate by an acid or passing through an ion exchange resin layer; (2) a colloidal silica obtained by heating and maturing the silica sol of (1); (3) a silica gel obtained by gelling silica sol in which formation conditions thereof are changed whereby primary particles of a silica gel having a diameter of several $\mu$m to 10 $\mu$m are siloxane bonded to form three-dimensional secondary particles; and (4) a synthetic silicic acid compound mainly comprising silicic acid obtained by heating silica sol, sodium silicate, sodium aluminate, etc.

Fumed silica to be used in the present invention is also called to as the drying method silica, and the fumed silica can be generally prepared by a flame hydrolysis method. More specifically, it has been known a method in which silicon tetrachloride is burned with hydrogen and oxygen. In this method, silanes such as methyl trichlorosilane, trichlorosilane, or the like, may be used alone in place of silicon tetrachloride or in combination with silicon tetrachloride. The fumed silica is commercially available from Nippon Aerosil K.K. (Japan) under the trade name of Aerosil, and K. K. Tokuyama (Japan) under the trade name of QS type.

An average primary particle size of the fumed silica to be used in the present invention is preferably 30 nm or less, more preferably 15 nm or less for obtaining higher glossiness. It is further preferred to use fumed silica having an average primary particle size of about 3 to 15 nm and has a specific surface area measured by the BET (Brunauer-Emmett-Teller) method of about 200 $m^2/g$ or more. Particularly preferred fumed silica to be used is that having an average primary particle size of about 3 to 10 nm and a specific surface area measured by the BET method of about 250 to 500 $m^2/g$. The BET method herein mentioned means one of a method for measuring surface area of a powder material by a gas phase adsorption method and is a method of obtaining a total surface area possessed by 1 g of a sample, i.e., a specific surface area, from an adsorption isotherm. In general, as an adsorption gas, a nitrogen gas has been used in many cases, and a method of measuring an adsorption amount obtained by the change in pressure or a volume of a gas to be adsorbed has most frequently been used. Most famous equation for representing isotherm of polymolecular adsorption is a Brunauer-Emmett-Teller equation which is also called to as a BET equation and has widely been used for determining a surface area of a substance to be examined. A specific surface area can be obtained by measuring an adsorption amount based on the BET equation and multiplying the amount with a surface area occupied by the surface of one adsorbed molecule.

In the present invention, it is preferred to contain inorganic fine particles in the ink-receptive layer in an amount of 8 $g/m^2$ or more, more preferably in the range of 10 to 30 $g/m^2$. In the ink-receptive layer, a hydrophilic binder is contained in combination with the inorganic fine particles. An amount of the hydrophilic binder is preferably 35% by weight or less, particularly preferably 10 to 30% by weight based on the amount of the inorganic fine particles. If the amount of the hydrophilic binder is too large, an ink absorption property is lowered.

In the present invention, as the hydrophilic binder to be used with the inorganic fine particles, conventionally known various kinds of binders may be used, and a hydrophilic binder having a high transparency and a high ink-absorption property is preferably used. For using the hydrophilic binder, it is important that the hydrophilic binder does not clog the voids by swelling at the initial stage of permeation of ink. From this point of view, a hydrophilic binder having a relatively low swellability at around the room temperature is preferably used. A particularly preferred hydrophilic binder is a completely or partially saponified polyvinyl alcohol or a cationic-modified polyvinyl alcohol.

Among the polyvinyl alcohols, particularly preferred is a completely or partially saponified polyvinyl alcohol having a saponification degree of 80% or more. Those having an average polymerization degree of 200 to 5000 are also preferred.

Also, as the cationic-modified polyvinyl alcohol, there may be mentioned, for example, as disclosed in Japanese Provisional Patent Publication No. 10483/1986, a polyvinyl alcohol having a primary to tertiary amino groups or a quaternary ammonium group on the main chain or side chain of the polyvinyl alcohol.

In the present invention, the ink-receptive layer preferably contains a cross-linking agent (film hardening agent) in combination with the above hydrophilic binder. Specific examples of the cross-linking agent may include an aldehyde type compound such as formaldehyde and glutaraldehyde; a ketone compound such as diacetyl and chloropentanedione; bis(2-chloroethylurea)-2-hydroxy-4,6-dichloro-1,3,5-triazine, a compound having a reactive halogen as disclosed in U.S. Pat. No. 3,288,775; divinylsulfone; a compound having a reactive olefin as disclosed in U.S. Pat. No. 3,635,718; a N-methylol compound as disclosed in U.S. Pat. No. 2,732,316; an isocyanate compound as disclosed in U.S. Pat. No. 3,103,437; an aziridine compound as disclosed in U.S. Pat. Nos. 3,017,280 and 2,983,611; a carbodiimide type compound as disclosed in U.S. Pat. No. 3,100,704; an epoxy compound as disclosed in U.S. Pat. No. 3,091,537; a halogen carboxyaldehyde compound such as mucochloric acid, a dioxane derivative such as di-hydroxydioxane, an inorganic cross-linking agent such as chromium alum, potassium alum, zirconium sulfate, boric acid and a borate, and they may be used singly or in combination of two or more. Of these, boric acid or a borate is particularly preferred.

The ink-receptive layer of the present invention preferably contains a cationic compound. As the cationic compound to be used in the present invention, there may be mentioned, for example, polyethyleneimine, polydiallylamine, polydialkyldiallylamine, polyallylamine, polyalkylamine, alkylamine polymerized material, alkylamine epichlorohydrin polycondensate, as well as polymers having a primary to tertiary amino groups or a quaternary ammonium group as disclosed in Japanese Provisional Patent Publications No. 20696/1984, No. 33176/1984, No. 33177/1984, No. 155088/1984, No. 11389/1985, No. 49990/1985, No. 83882/1985, No. 109894/1985, No. 198493/1987, No. 49478/1988, No. 115780/1988, No. 280681/1988, No. 40371/1989, No. 234268/1994, No. 125411/1995 and No. 193776/1998, etc. A weight average molecular weight (Mw) of these cationic polymers is preferably about 5,000 or more, more preferably about 5,000 to about 100,000.

An amount of these cationic polymers is preferably about 1 to 10% by weight, more preferably about 2% to 7% by weight based on the amount of the inorganic fine particles.

In the present invention, the surface pH of the ink-receptive layer is a surface pH obtained by dropping distilled water on the surface of the ink-receptive layer and measuring the pH at the distilled water portion after 30 seconds from dropping according to the method described in J.TAPPI paper pulp testing method No. 49.

The surface pH of the ink-receptive layer is preferably adjusted in the state of the coating solution, but the pH of the coating solution and the surface pH of the dried film are not necessarily accorded with each other. Thus, it is necessary to previously obtain the relationship between the pH of the coating solution and that of the dried film obtained by the coating solution by experiments to make the surface pH a predetermined value. The pH of the coating solution for forming the ink-receptive layer can be adjusted suitably by using an acid and/or an alkali. As the acid to be used, there may be mentioned an inorganic acid such as hydrochloric acid, nitric acid, sulfuric acid and phosphoric acid, and an organic acid such as acetic acid, citric acid and succinic acid. As the alkali, there may be used sodium hydroxide, aqueous ammonia, potassium carbonate, trisodium phosphate, and as a weak alkali, an alkali metal salt of a weak acid such as sodium acetate.

The ink-receptive layer of the present invention may further contain various kinds of oil droplets to improve brittleness of a film. As such oil droplets, there may be mentioned a hydrophobic organic solvent having a high boiling (for example, liquid paraffin, dioctyl phthalate, tricresyl phosphate, silicone oil, etc.) or polymer particles (for example, particles in which at least one of a polymerizable monomer such as styrene, butyl acrylate, divinyl benzene, butyl methacrylate and hydroxyethyl methacrylate is polymerized) each having a solubility in water at room temperature of 0.01% by weight or less. Such oil droplets can be used in an amount in the range of about 10 to about 50% by weight based on the amount of the hydrophilic binder.

In the present invention, the ink-receptive layer may contain a surfactant. The surfactant to be used may be either type of an anionic, a cationic, a nonionic or a betaine type surfactant, each of which may be a low molecular weight or a high molecular weight. One or more surfactants is/are added to a coating solution for the ink-receptive layer. When two or more kinds of surfactants are used in combination, a combination of an anionic type and a cationic type is not preferred. An amount of the surfactant to be added is preferably about 0.001 to 5 g, more preferably about 0.01 to 3 g per 100 g of the binder constituting the ink-receptive layer.

In the present invention, to the ink-receptive layer, various kinds of conventionally known additives such as a coloring dye, a coloring pigment, a fixing agent of an ink dye, an UV absorber, an antioxidant, a dispersant of the pigment, an antifoaming agent, a leveling agent, an antiseptic agent, a fluorescent brightener, a viscosity stabilizer and a pH controller may be added.

As the support to be used in the present invention, a water resistant support is preferably used. As the water resistant support, there may be mentioned a plastic resin film such as a polyester resin including polyethylene terephthalate, a diacetate resin, a triacetate resin, an acryl resin, a polycarbonate resin, polyvinyl chloride, a polyimide resin, cellophane, celluloid, and a resin coated paper in which a polyolefin resin is laminated on the both surfaces of paper. A thickness of the water resistant support to be used in the present invention is preferably about 50 to 300 $\mu$m.

Among the above-mentioned water resistant support, a resin-coated paper is particularly preferably used. A base paper constituting the polyolefin resin-coated paper is not particularly limited, and any paper generally used may be employed. More preferably a smooth base paper such as that used as paper for a photographic support may be used. As pulp constituting the base paper, natural pulp, regenerated pulp, synthetic pulp, or the like, maybe used singly or in combination of two or more. In the base paper, various additives conventionally used in the papermaking industry such as a sizing agent, a strengthening additive of paper, a loading material, an antistatic agent, a fluorescent brightener, a dye, and the like may be formulated.

Moreover, a surface sizing agent, a surface strengthening additive of paper, a fluorescent brightener, an antistatic agent, a dye, an anchoring agent, and the like may be coated on the surface of the sheet.

A thickness of the base paper is not particularly limited, and preferably that having a good surface smoothness prepared by compressing paper during paper-making or after paper-making by applying pressure using a calender, etc. A basis weight thereof is preferably about 30 to 250 g/m$^2$.

As a resin of the polyolefin resin-coated paper, a polyolefin resin or a resin which cures by irradiation of electron rays may be used. The polyolefin resin may include a homopolymer of an olefin such as low density polyethylene, high density polyethylene, polypropylene, polybutene, polypentene, etc.; a copolymer comprising two or more olefins such as an ethylenepropylene copolymer, etc.; or a mixture thereof, and these polymers having various densities and melt viscosity indexes may be used singly or in combination of two or more.

Also, to the resin of the polyolefin resin-coated paper, various kinds of additives including a white pigment such as titanium oxide, zinc oxide, talc, calcium carbonate, etc.; an aliphatic amide such as stearic amide, arachidamide, etc.; an aliphatic metal salt such as zinc stearate, calcium stearate, aluminum stearate, magnesium stearate, etc.; an antioxidant such as Irganox 1010, Irganox 1076 (both trade names, available from Ciba Geigy AG), etc.; a blue-color pigment or dye such as cobalt blue, ultramarine blue, cecilian blue, phthalocyanine blue, etc,; a magenta-color pigment or dye such as cobalt violet, fast violet, manganese violet, etc.; a fluorescent brightener, an UV absorber, etc. may be preferably added singly or optionally combining two or more.

The resin-coated paper which is a support preferably used in the present invention can be prepared by casting a melted resin under heating on a running base paper in the case of using a polyolefin resin, which is the so-called extrusion coating method, whereby the both surfaces of the base paper are coated by the resin. In the case of using a resin which cures by irradiation of electronic rays, the resin is coated on a base paper by means of a coater conventionally used such as a gravure coater, a blade coater, etc., and then, electronic rays are irradiated to the resin whereby coating the base paper with the resin. Also, it is preferred to subject an activation treatment to a base paper before coating the resin to the base paper, such as a corona discharge treatment, a flame treatment, etc. A surface of the support on which an ink-receptive layer is formed (a front surface) may be a gloss surface or a matte surface depending on the use, and a gloss surface is particularly preferably used. It is not necessarily subjected to resin coating at the back surface of the base paper, but in view of preventing curl, it is preferred to coat the both surfaces of the base paper with the resin. The back surface is generally a non-gloss surface, and the activation treatment such as the corona discharge treatment, the flame treatment, etc. may be applied to the front surface or to the both surfaces of the front and back surfaces depending on the necessity. Also, a thickness of the resin-coated layer is not particularly limited, and it is generally coated with a thickness in the range of about 5 to 50 $\mu$m on the front surface or both of the front and back surfaces.

In the present invention, the coating method for coating the ink-receptive layer on the above-mentioned support is not particularly limited, and a coating method conventionally known in the art may be used. For example, there may be mentioned a slide bead system, a curtain system, an extrusion system, an air knife system, a roll coating system, a rod bar coating system, etc.

In the ink-jet recording material of the present invention, the ink-receptive layer may comprise two or more layers. Also, at an upper side, at an intermediate portion or at a lower side of the ink-receptive layer, a subbing layer, an intermediate layer, a protective layer, a swelling layer or the like may be provided for the purpose of improving adhesion with the support or protecting the ink-receptive layer, or a back-coating layer may be provided at an opposite side of the support to the side on which the ink-receptive layer is provided. A surface pH of the ink-receptive layer surface of the present invention is a surface pH of the whole surface including a protective layer, a swelling layer, or the like when these layers are provided on the ink-receptive layer.

A recording method of the present invention comprises a recording system in which printing is carried out by adhering an ink composition to a recording medium so as to conduct printing on the recording medium. As the ink-jet recording material to be used in the present invention, that as mentioned above is used as the recording medium.

An ink-jet recording method of the present invention comprises a recording system in which printing is carried out by spraying droplets of an ink composition to adhere the droplets to a recording medium so as to conduct printing on the recording medium. As the ink-jet recording material to be used in the present invention, that as mentioned above is also used as the recording medium.

Also, the present invention relates to a recorded material on which printing has been conducted by the recording method as mentioned above.

EXAMPLES

The present invention is described in detail by referring to Examples, but the scope of the present invention is not limited by these.

Example 1

The present invention will be described in detail with reference to examples hereinafter. However, the present invention shall not be limited to the examples. "Parts" in the examples mean "parts by weight in terms of solid contents".

A resin composition comprising a low-density polyethylene (70 parts), a high-density polyethylene (20 parts) and titanium oxide (10 parts) was applied to the front and back surfaces of a 120 g/m$^2$ paper substrate comprising a pulp formulation of a bleached kraft pulp of hardwood (LBKP, 50 parts) and a bleached sulfite pulp of hardwood (LBSP, 50 parts) in amounts of 18 g/m$^2$ and 25 g/m$^2$, respectively, to prepare a resin coated paper.

An ink-receptive layer having the following composition was applied to the above substrate and dried to prepare an ink-jet recording material. In the application of the ink-receptive layer, firstly, fumed silica was fully dispersed into an aqueous dispersing medium (containing 5% by weight of ethanol) by means of a homogenizer to prepare a dispersion containing 20% by weight of the fumed silica, and the following additive was then added to the dispersion to prepare a coating solution containing 10% by weight of the fumed silica. The pH of the coating solution was adjusted in advance such that the pH of the surface of the applied and dried ink-receptive layer should be 3.7.

| <Ink-receptive layer> | |
|---|---|
| Fumed silica (average primary particle diameter: 7 nm, specific surface area determined by a BET method: 300 m$^2$/g) | 19 g/m$^2$ |
| Alkylamine epichlorohydrin polycondensate (cationic polymer, weight average molecular weight: about 7,000) | 0.6 g/m$^2$ |
| Polyvinyl alcohol (trade name: PVA235, available from KURARAY Co., LTD., saponification degree: 88%, average polymerization degree: 3,500) | 4.7 g/m$^2$ |
| Boric acid | 0.7 g/m$^2$ |
| Surfactant (trade name: SWAM AM-2150, product of Nihon Surfactant Kogyo K.K.) | 0.06 g/m$^2$ |

The ink-jet recording material prepared as described above was slit into a roll form having a width of 127 mm and a length in a longitudinal direction of 10 m. In this case, the ink-jet recording material was wound around a paper tube (core) with the surface of the ink-receptive layer exposed outside to roll up the ink-jet recording material into a roll form. A protective sheet was wound around the rolled ink-jet recording material twice, and the resulting roll was put in a packaging bag made of polyethylene and then put in a box to prepare a packaged product.

In the preparation of the above packaged product, protective sheets made of paper having the following surface pHs were used. The type of the paper used in the sheets was kraft paper having a thickness of 100 $\mu$m.

Protective sheet A: surface pH=4.0

Protective sheet B: surface pH=4.5

Protective sheet C: surface pH=5.0

Protective sheet D: surface pH=5.5

Protective sheet E: surface pH=6.0

After packaged products of the ink-jet recording material prepared by use of the above five kinds of protective sheets made of paper were preserved at 50° C. for one day, printing was conducted on the surfaces of the outermost ink-receptive layers which were in contact with the protective sheets and the surfaces of inner ink-receptive layers by means of a printer to evaluate hues. In the evaluation of the hues, PM-800C of SEIKO EPSON CORPORATION was used as the printer, and a solid image of each color was printed to a concentration of around 1.5 by use of CMYK inks (cyan, magenta, yellow and black inks). After printing, for the solid image of each color, values of psychometric lightness L* and chromaticnesses a* and b* which were defined in JIS-Z8730 were measured by means of a densitometer (Spectrolino manufactured by GRETAG CO., LTD.) in accordance with a measurement method defined by JIS-Z8722 to determine a value of ΔE*ab represented by the following numerical formula. The results are shown in Table 1. Table 1 shows that the smaller the ΔE*ab value is, the smaller a change in hue is.

$$\Delta E^*_{ab} = \sqrt{(L^*_A - L^*_B)^2 + (a^*_A - a^*_B)^2 + (b^*_A - b^*_B)^2}$$

In the above formula, $L_A$*, $a_A$* and $b_A$* are measured values with respect to the surface of the outermost wounded ink-receptive layer, and $L_B$*, $a_B$* and $b_B$* are measured values with respect to the surface of the inner ink-receptive layer.

TABLE 1

| Protective | ΔE · ab | | | | Difference | |
|---|---|---|---|---|---|---|
| sheet | C | M | Y | K | in pH | Remark |
| A | 0.3 | 0.3 | 0.3 | 0.2 | 0.3 | This invention |
| B | 0.4 | 0.3 | 0.3 | 0.2 | 0.8 | This invention |
| C | 0.8 | 0.4 | 0.5 | 0.3 | 1.3 | This invention |
| D | 2.6 | 0.5 | 0.7 | 0.4 | 1.8 | Comparative |
| E | 4.6 | 0.6 | 0.8 | 0.4 | 2.3 | Comparative |

In Table 1, the difference in pH is a difference between the pH of the surface of the outermost ink-receptive layer and the pH of the surface of each protective sheet.

It can be understood from the above results that while the packaged products of the present invention exhibit small changes in hue, packaged products for comparison exhibit significant changes in hue of the solid images filled with C (cyan) in particular. It can be seen that, of the packaged products of the present invention, particularly those using the protective sheets A and B having a difference of 1.0 or smaller between the pH of the surface of the outermost ink-receptive layer and the pH of the surface of the protective sheet exhibit smaller changes in hue.

Example 2

An ink-jet recording material was prepared in the same manner as in Example 1 and cut into a plurality of sheets (329 mm×483 mm each), and 20 of the sheets were stacked in the same direction to prepare a sheet-accumulated form product. A protective sheet was placed on the outermost (uppermost) surface of the ink-receptive layer of the ink-jet recording material for protection thereof, and the resulting accumulated sheets were put in a package bag made of polyethylene and then put it in a box to prepare a packaged product.

In the preparation of the above packaged product, protective sheets made of paper (A1 to E1 ) having the same surface pHs as those of the protective sheets made of paper used in Example 1 were used. However, the thickness of paper was changed to 400 $\mu$m.

After packaged products of the ink-jet recording material prepared by use of the above five kinds of protective sheets made of paper were preserved at 50° C. for one day, printing was conducted on the surfaces of the uppermost ink-receptive layers which were in contact with the protective sheets and the surfaces of inner ink-receptive layers in the same manner as in Example 1 to evaluate hues. As a result, the same results as those obtained in Example 1 were obtained. That is, while the packaged products of the present invention which used the protective sheets A1 (surface pH: 4.0), B1 (surface pH: 4.5) and C1 (surface pH: 5.0) exhibited small changes in hue, packaged products for comparison which used the protective sheets D1 (surface pH: 5.5) and E1 (surface pH: 6.0) exhibited significant changes in hue of the solid image filled with C (cyan) in particular.

Example 3

An ink-jet recording material was prepared, rolled up to a roll shape, and formed into a packaged product in the same manner as in Example 1. However, the following protective sheets were used instead.

Protective sheet F: A polyethylene resin was coated on one surface of the protective sheet E of Example 1 to a thickness of 20 $\mu$m. Packaging was carried out, so that the above-mentioned polyethylene resin surface would be in contact with the surface of the ink-receptive layer.

Protective sheet G: A protective sheet comprising a polyethylene resin film having a thickness of 50 $\mu$m.

Further, the ink-jet recording material was formed into a sheet-accumulated form and packaged as a product in the same manner as in Example 2. However, the following protective sheet was used instead.

Protective sheet H: A polyethylene resin was coated on one surface of the protective sheet E1 of Example 2 to a thickness of 20 $\mu$m. Packaging was carried out, so that the above-mentioned polyethylene resin surface would be in contact with the surface of the ink-receptive layer.

Evaluation of hue after printing was conducted on packaged products using the above protective sheets in the same manner as in Example 1. The results are shown in Table 2.

TABLE 2

| Packaged product | Protective Sheet | ΔE · ab C | M | Y | K | Remarks |
|---|---|---|---|---|---|---|
| Roll material | F | 0.1 | 0.2 | 0.2 | 0.1 | This invention |
| Roll material | G | 0.1 | 0.2 | 0.2 | 0.2 | This invention |
| Sheet material | H | 0.1 | 0.2 | 0.2 | 0.1 | This invention |

It was understood from the above results that the packaged products of the present invention which used the protective sheets made of paper F and H whose surfaces which made contact with the ink-receptive layers had been coated with the polyethylene resin layers to be water repellant and the protective sheet G comprising the polyethylene resin film exhibited smaller changes in hue than those of Examples 1 and 2. Of the above protective sheets F and G, the protective sheet F made of paper was superior to the protective sheet G made of paper in terms of packageability and suitability for automatic packaging.

Example 4

Roll state packaged products were prepared in the same manner as in Example 3 by use of the protective sheet F prepared in Example 3, provided that a surface pH of an ink-receptive layer of an ink-jet recording material has changed to 2.5, 3.5, 4.5, 5.5 or 6.5. As a result of a printing test conducted in the same manner as in Example 1, ΔE*ab representing a change in hue was small in all the cases as in the case of Example 3.

Further, for the above ink-jet recording materials in which the surface pH of the respective ink-receptive layers has changed, color reproducibility and water resistance of an original image, and the quality of the coated surface of the ink-receptive layer were evaluated relative to one another in accordance with the following methods.

<Color Reproducibility of Original Image>

A color image of an original image was printed by use of the same printer and ink as those used in Example 1, and the hue of the printed image was compared with that of the original image.

<Water Resistance>

After left to stand at 35° C. and 80% (Relative humidity) for two days, bleeding of a thin-lines image was evaluated.

<Quality of Coated Surface>

The surface of the ink-receptive layer was observed visually for occurrences of such coating defects as coating streaks and coating rejections and surface cracks.

<Evaluation Results of Color Reproducibility of Original Image>

(good) pH3.5=pH4.5=pH5.5=pH6.5>>pH2.5

<Water Resistance>

(good) pH2.5=pH3.5=pH4.5>pH5.5>pH6.5

<Quality of Coated Surface>

(good) pH2.5=pH3.5=pH4.5>pH5.5>>pH6.5

It is understood from the above results that the surface pH of the ink-receptive layer is preferably 3 to 6, more preferably 3 to 5.

As is clear from the above results, the packaged product of the present invention can provide a high-performance ink-jet recording material, which causes no non-uniformity in the hue of a printed image.

What is claimed is:

1. A packaged product for an ink-jet recording material which has a protective sheet for protecting a surface of an outermost ink-receptive layer of the ink-jet recording material, wherein a protective paper sheet in which a difference between the pH of its surface which makes contact with the surface of the outermost ink-receptive layer and the pH of the surface of the ink-receptive layer is 1.5 or smaller is used as the protective sheet.

2. The packaged product of claim 1, wherein the pH of the surface of the ink-receptive layer of the ink-jet recording material is 3 to 6.

3. The packaged product of claim 1, wherein the ink-receptive layer of the ink-jet recording material contains inorganic fine particles as a main component.

4. The packaged product of claim 3, wherein the inorganic fine particles are silica synthesized by a gas-phase method.

5. The packaged product of claim 2, wherein the ink-receptive layer of the ink-jet recording material contains inorganic fine particles as a main component.

6. The packaged product of claim 5, wherein the inorganic fine particles are silica synthesized by a gas-phase method.

7. A recording method which causes an ink composition to adhere to a recording medium so as to conduct printing on the recording medium, wherein the ink-jet recording material of claim 1 is used as the recording medium.

8. A recorded material on which printing has been conducted by the recording method of claim 7.

9. An ink-jet recording method which sprays droplets of an ink composition and causes the droplets to adhere to a recording medium so as to conduct printing on the recording medium, wherein the ink-jet recording material of claim 1 is used as the recording medium.

10. A recorded material on which printing has been conducted by the recording method of claim 9.

11. A packaged product for an ink-jet recording material which has a protective sheet for protecting a surface of an outermost ink-receptive layer of the ink-jet recording material, wherein a protective paper sheet whose surface which makes contact with the surface of the outermost ink-receptive layer has been made water-resistant or a protective plastic sheet is used as the protective sheet, and a surface pH of the ink-receptive layer is 3 to 6.

12. The packaged product of claim 11, wherein the ink-receptive layer of the ink-jet recording material contains inorganic fine particles as a main component.

13. The packaged product of claim 12, wherein the inorganic fine particles are silica synthesized by a gas-phase method.

14. A recording method which causes an ink composition to adhere to a recording medium so as to conduct printing on the recording medium, wherein the ink-jet recording material of claim 11 is used as the recording medium.

15. A recording material on which printing has been conducted by the recording method of claim 14.

16. An ink-jet recording method which sprays droplets of an ink composition and causes the droplets to adhere to a recording medium so as to conduct printing on the recording medium, wherein the ink-jet recording material of claim 11 is used as the recording medium.

17. A recording material on which printing has been conducted by the recording method of claim 16.

18. The packaged product of claim 11, wherein the surface pH of the ink-receptive layer is 3 to 5.

19. The packaged product of claim 18, wherein the ink-receptive layer of the ink-jet recording material contains inorganic fine particles as a main component.

20. The packaged product of claim 19, wherein the inorganic fine particles are silica synthesized by a gas-phase method.

21. The packaged product of claim 11, wherein the surface pH of the ink-receptive layer is 3.5 to 4.5.

22. The packaged product of claim 21, wherein the ink-receptive layer of the ink-jet recording material contains inorganic fine particles as a main component.

23. The packaged product of claim 22, wherein the inorganic fine particles are silica synthesized by a gas-phase method.

* * * * *